United States Patent [19]

Güntert et al.

[11] Patent Number: 4,705,005

[45] Date of Patent: Nov. 10, 1987

[54] FUEL INJECTION PUMP FOR INTERNAL COMBUSTION ENGINES

[75] Inventors: Josef Güntert, Gerlingen; Walter Häfele, Fellbach; Helmut Tschöke, Ostfildern, all of Fed. Rep. of Germany

[73] Assignee: Robert Bosch GmbH, Stuttgart, Fed. Rep. of Germany

[21] Appl. No.: 800,248

[22] Filed: Nov. 21, 1985

[30] Foreign Application Priority Data

Dec. 24, 1984 [DE] Fed. Rep. of Germany ..... 3447375

[51] Int. Cl.[4] ..... F02M 59/34

[52] U.S. Cl. ..... 123/500; 123/503; 417/494

[58] Field of Search ..... 123/449, 500, 501, 503; 417/494, 499

[56] References Cited

U.S. PATENT DOCUMENTS 2,147,390 2/1939 Vaudet ..... 123/139
2,746,443 5/1956 Meyer ..... 123/449
3,312,209 4/1957 Chmura ..... 123/501 X
3,667,437 6/1972 Dreisin ..... 123/139
4,211,520 7/1980 Kranc ..... 417/494

FOREIGN PATENT DOCUMENTS 3018791 11/1981 Fed. Rep. of Germany ..... 123/449

*Primary Examiner*—Tony M. Argenbright
*Attorney, Agent, or Firm*—Edwin E. Greigg

[57] ABSTRACT

A fuel injection pump for internal combustion engines, in which at least during normal engine operation the injection quantity is effected by controlling a fuel quantity control conduit which is provided in the pump piston in communication with the pump work chamber, via a control slide that is displaceable on the pump piston in cooperation with fuel quantity control openings, the axial position of the control slide determining the onset and end of supply. The earliest possible supply onset is further determined by a supply onset control opening disposed in the pump piston, which opening is sealed by entering into the cylinder liner after a predetermined stroke extent has been traversed. Subsequent to this entry, an injection pressure can build up in the pump work chamber.

19 Claims, 3 Drawing Figures

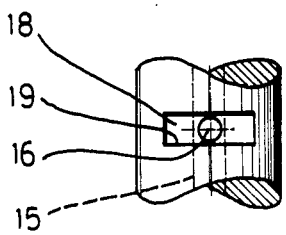
Fig.2
Fig. 3
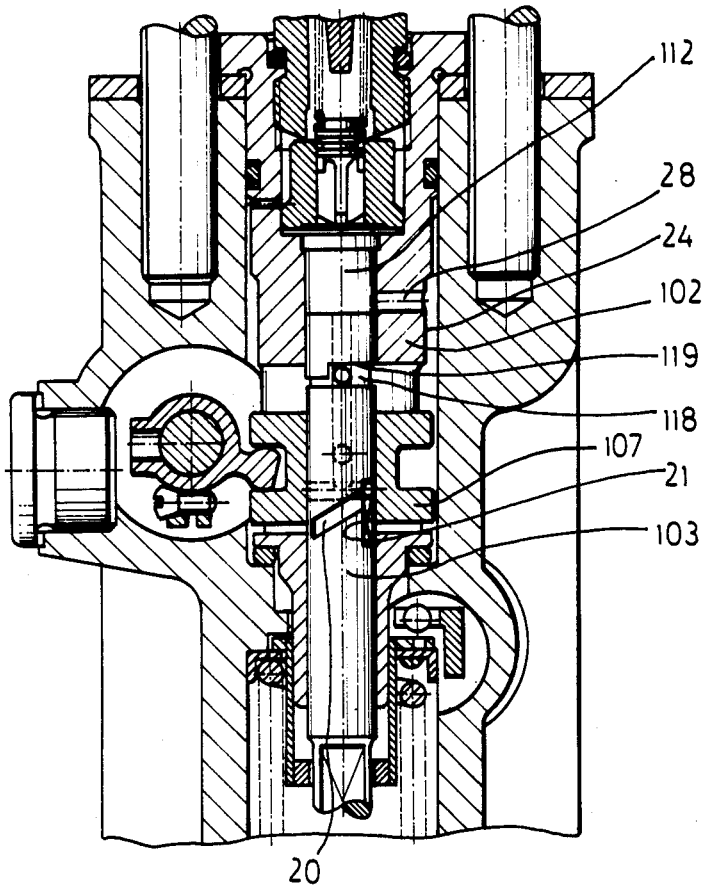

FUEL INJECTION PUMP FOR INTERNAL COMBUSTION ENGINES

BACKGROUND OF THE INVENTION

The invention is directed to improvements in fuel injection pumps having a pump piston actuated by a control slide.

Slide-controlled pumps of this type are used primarily for high feed capacities, usually for Diesel engines operating at a lesser speed; the result is inaccuracies in fuel metering, which become particularly perceptible in the form of rough engine operation, and in which the damage that may be caused by incorrect fuel metering is particularly expensive to repair. In a known fuel injection pump of this type (U.S. Pat. No. 3,667,437), after a stroke determined by the position of the control slide has been traversed, the quantity control opening plunges into the inner bore of the control slide whereupon injection can begin, because of this blockage of the quantity control conduit. Then, as soon as the opening in this quantity control conduit coincide with an oblique groove disposed in the inner bore of the control slide, the injection is once again interrupted, by relieving the pressure in the pump work chamber. The onset and end of supply are determined here by the stroke position of the control slide, and the injection quantity is determined by rotating the control slide. The pump piston can also be rotated easily, in order to achieve a basic setting.

In another known fuel injection pump of this type (U.S. Pat. No. 2,147,390), in addition to other options the pump piston is rotated in order to vary the fuel quantity, and the control slide is axially displaced in order to vary the supply onset. In all these control operations, a respective quantity control opening on one of the control members (pump piston or control slide) cooperates with an oblique control edge on the other control member (control slide or pump piston). In each case, however, the supply onset is determined by the introduction of the quantity control opening into the bore of the control slide, and the instant at which this happens is dependent on the stroke position of the control slide.

The danger accordingly arises that with certain adjustments, usually those tending toward an early injection onset, the injection will occur in a range that is impermissible for the engine, or that a failure of a control element may cause the control slide to remain in such a position, resulting in a supply onset that is impermissible for the engine. In the known pumps, a shutoff can generally be effected by displacing the control slide into its extreme upper or lower position, in which no further control of fuel quantity takes place and the pump work chamber remains constantly relieved. When the control slide is displaced into one of these extreme positions, however, extreme variations in the supply onset are temporarily effected as well; that is, if the control slide is displaced downward, there will be an extremely early supply onset, and if it is displaced upward the supply onset will be extremely late. These positions, which are not adapted to either the rpm or the load, lead to engine damage.

A further disadvantage of these known fuel injection systems is that the operation of filling the pump work chamber is dependent upon the time variable for the fuel supply, which in turn is determined by the position of the control slide. For instance, if a large injection quantity is required, then during the intake stroke, as during the compression stroke, the relief conduit, via which the pump work chamber must be filled with fuel, is open only relatively briefly. At relatively high rpm the effect of this is an extremely small time increment for the task, resulting in incomplete filling of the pump work chamber during the intake stroke, so that during the ensuing compression stroke either the required fuel quantity cannot be furnished, or else cavitation will occur as a result of the gases trapped in the pump work chamber.

OBJECTS AND SUMMARY OF THE INVENTION

It is a principal object of the fuel injection pump according to the invention that because of the cooperation of the supply onset control opening provided in the pump piston with the stationary pump cylinder, the earliest supply onset is determined independently of the axial position of the control slide. Accordingly, even if the control slide is displaced to its extreme lower position, the supply onset can no longer take place at an overly early time, one which is critical for the engine, and which could possibly result in the destruction of the engine.

It is another object of the invention to provide a diversion opening of a diversion conduit, which leads to a chamber which is at a lower pressure, especially the suction chamber, disposed in the pump cylinder surface. In this embodiment after a maximum supply stroke of the pump piston, this diversion opening can coincide with the supply onset control opening provided in the pump cylinder.

It is still another object of the invention to provide that the end of supply is determined independently of the stroke position of the control slide, so that even if a control element failure should cause the control slide to be displaced into an extreme position causing an overly late injection onset, an impermissible load would still not be put on the engine, because the end of supply is determined not by the control slide, as it is during normal engine operation, but by the relieving of the pump work chamber effected previously by means of the diversion opening. This reduction of the injection quantity can be carried far enough that a zero supply takes place, if the supply onset control opening comes to coincide with the diversion opening before the quantity control conduit enters into the bore of the control slide.

It is yet another object of the invention to provide that the high-pressure supply is terminated before the roller of the roller tappet, given a cam drive mechanism, leaves the linear portion of the drive cam and reaches a curved portion; as a result, because of the opposing parts pressed against one another, the contact surface (a variably wide line) would be increased. At equally high force, the cyclic compressions in the pairing of curved/-straight surfaces vis-a-vis curved/curved surfaces can be multiplied many times without any danger of damage to the drive train.

It is still a further object of the invention to provide that the pump piston can be rotatable for controlling fuel quantity, and the upper limiting edge of the control groove can have a stepped and/or oblique course; that is, the upper control edge, oriented toward the pump work chamber, of the supply onset control opening can take an offset course, so that advantageously when the pump piston is rotated, not only will the injection quantity but also the maximum supply stroke, determined independently of the control slide, be varied. As a result, by rotating the pump piston, the maximum supply quantity intended for full load can be increased to the larger maximum supply quantity intended for engine starting.

It is yet another object of the invention to ensure that the control cross sections between the control slide and the pump piston are maintained solely within the maximum required size, and thus the supply onset control opening in the opened or uncovered position, and/or the diversion opening of the diversion conduit, discharge into a suction chamber serving to supply fuel. The filling of the pump work chamber is thereby assured independently of the variable control cross section between the control slide and the pump piston quantity control opening, because at bottom dead center of the pump piston, via the supply onset control opening and/or the diversion opening, only a slight throttling effect prevails at the inflow, because of the relatively large cross sections particularly at high rpm.

It is yet still another object of the invention to provide a pump which can be used at higher rpm than can the known pumps. Filling of the pump work chamber is required not only to attain maximal fuel supply, but also to prevent cavitation inside the pump work chamber.

The invention will be better understood and further objects and advantages thereof will become more apparent from the ensuing detailed description of preferred embodiments taken in conjunction with the drawings.

BRIEF DESCRIPTION OF THE DRAWINGS

FIG. 2 is a portion of the pump piston of FIG. 1 rotated by 90° and shown on a larger scale; and FIG. 3 is an illustration corresponding to FIG. 1, showing the second exemplary embodiment of the invention.

DESCRIPTION OF THE PREFERRED EMBODIMENTS

Figure 1:
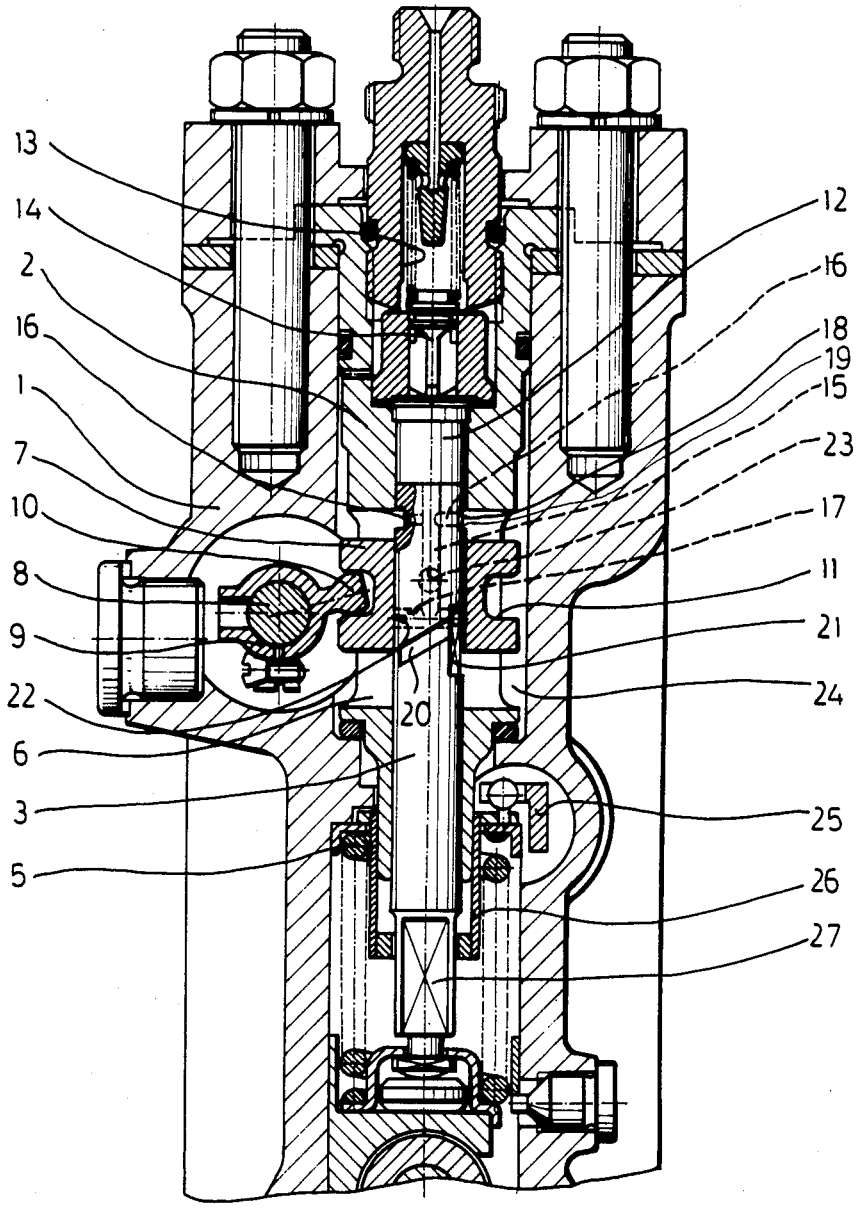
FIG. 1 is a longitudinal section taken through the upper portion of an in-line fuel injection pump, as the first exemplary embodiment of the invention.

A plurality of cylinder liners 2, only one of which is shown, is inserted in a line into a housing 1 of an in-line fuel injection pump. In the cylinder liners 2, pump pistons 3 are driven via a camshaft, not shown, counter to the force of a spring 5 to effect the axial movement embodying the working stroke. A recess 6 is provided in the cylinder liner 2, which liner receives a control slide 7 that is axially displaceable on the pump piston 3. The individual control slides 7, which are disposed on the pump pistons 3 disposed in a pump, are displaced in common by a governor rod 8; to effect this displacement, one tension ring 9 is provided per control slide 7, each having a head 10, firmly fastened on the rotatable governor rod 8; the head 10 is arranged to engage an annular groove 11 of the control slide 7.

A pump work chamber 12 is defined by the pump piston 3 and the cylinder liner 2. A pressure conduit 13 in which a pressure valve 14 is disposed leads from the pump work chamber to a pressure line, not shown, which ends at an injection nozzle of the internal combustion engine.

A blind bore 15 extends within the pump piston and discharges into the pump work chamber 12; the bore 15 is intersected adjacent one extremity near the pump work chamber 12 by a first transverse bore 16, while its opposite extremity discharges into a second transverse bore 17. The first transverse bore 16 terminates in grooves 18 disposed on the jacket surface of the piston, which grooves 18 are formed by machining transversely extending cuts therein, each of which grooves has a control edge 19 extending at right angles to the direction of movement. The second transverse bore 17 discharges into two oblique grooves 20 and two longitudinal grooves 21, only one of each of which is shown. The second of each pair of grooves is located on the opposite, rear side of the piston. The grooves 20, 21 are controlled by the control slide 7 for fuel quantity control by being introduced into the inner bore 22 of the control slide 7 during the stroke of the pump piston 3; upon that occurence, the pump work chamber 12 is blocked in this direction, so that the pressure required for injection can build up, until such moment as the oblique groove 20 becomes coincident with a relief bore 23 disposed on the control slide 7. This compression stroke, which enables high pressure in the pump work chamber 12, varies in extent depending upon the rotational position of the pump piston 3.

The recess 6 communicates with a suction chamber 24 provided in the housing, which chamber is filled with fuel at low pressure. In addition, the suction chamber 24 also communicates with the grooves 18, 20 and 21, as long as these grooves are not covered by the control slide 7 or the cylinder liner 2.

The pump piston 3 can be rotated in a known manner by an rpm governor, not shown, via a governor rod 25; to effect this drive, a driver member 26 on the governor rod 25 engages a flattened area 27 on the pump piston.

The first exemplary embodiment shown in FIGS. 1 and 2 operates as follows:

During the intake stroke of the pump piston 3 and in the vicinity of bottom dead center of the piston movement, fuel flows out of the suction chamber 24 into the pump work chamber 12 via the openings serving to effect quantity control, namely the oblique groove 20 and the longitudinal groove 21 as well as the bores 17 and 15. Fuel also flows out of the suction chamber 24 into the pump work chamber 12 via the grooves 18, the transverse bore 16 and the end portion of the blind bore 15. While at bottom dead center of the pump piston 3, the latter inflow route has a cross section which is always of constant size, the inflow cross section via the grooves 20 and 21 depends on the position of the control slide 7; furthermore, it is also possible for these two grooves 20, 21 to be covered and closed completely by the control slide 7, if the control slide assumes a correspondingly downwardly displaced position compared to the position shown in FIG. 1.

During the ensuing compression stroke of the pump piston 3, after a fixed pre-stroke of specific length has been traversed, the control grooves 18 pass under the cylinder liner 2, blocking communication via the transverse bore 16. Only after this pre-stroke has been executed can pressure build up within the pump work chamber 12, that is, if the oblique groove 20 and the longitudinal groove 21 are covered by the control slide 7. The supply onset, following a sufficient pressure buildup in the pump work chamber 12, can thus take place no earlier than after a pre-stroke has been executed, the length of which is determined by the position of the grooves 18, but onset is further determined by the stroke of the pump piston 3 needed to cover the grooves 20 and 21 as well. The end of injection, as already described, is then determined by the point at which the oblique groove 20 is revealed by the relief bore 23. Depending upon the rotational position of the pump piston 3, this end of supply can vary in lateness—at least for a given position of the control slide—so that the injection quantity depends on the rotational position of the pump piston 3; that is, the injection quantity is varied by rotating the pump piston 3.

The supply onset or injection onset, on the contrary, is determined for normal engine operation by the axial position of the control slide 7; that is, the lower the position of the control slide 7, the earlier onset of fuel supply takes place and the higher it is located, the later injection will begin. Compared with this supply onset which is determined by the control slide 7 and is variable, the supply onset that is determined by the grooves 18 after the pre-stroke has been executed is always constant, so that the actual supply onset is determined either by the control slide or by the grooves 18, depending upon the axial position of the control slide 7. In each case, the earliest possible supply onset is determined by the grooves 18. If the control slide 7 is displaced downwardly into an extreme position for early supply onset, then beyond a certain position the longitudinal grooves 21 enter into the control slide 7 before the transverse grooves 18 are blocked by the pump cylinder liner, as a result of which these grooves 18 determine the supply onset, which therefore occurs as early as possible and is constant. Now, the farther downward the control slide 7 is displaced, the shorter will be the remaining stroke of the pump piston 3 between the entrance of the transverse grooves 18 into the cylinder liner, which determines the supply onset, and the coincidence of the oblique grooves 20 with the relief bore 23, which causes a corresponding decrease in the injection quantity. The farther downward the control slide 7 is displaced, in the direction of earlier injection, the smaller the injection quantity will become, down to a zero supply quantity; the result of that would be a shutdown of the motor. This may be advantageous, particularly in the event that a failure of the control element of the governor rod 8 causes the control slide 7 to drop downward by its own weight, so that the failure of the governor apparatus would interrupt the injection.

In the second exemplary embodiment shown in FIG. 3, which in principle functions the same as the first exemplary embodiment, an annular groove 118 is disposed on the pump piston 103 in order to generate a pre-stroke; the annular groove 118 has a stepped control edge 119 at the top. Also provided in the cylinder liner 102 is a radial bore 28 acting as a diversion conduit, which at bottom dead center UT of the pump piston 103 discharges into the pump work chamber 112 on one end and on the other end leads to the suction chamber 24.

In this second exemplary embodiment, the radial bore 28 serves as an additional possible means of filling the pump work chamber 112. This bore 28 also serves as a diversion opening, in that during the compression stroke of the pump piston 103, after a maximum possible compression stroke has been traversed, the annular groove 118 which previously controlled the supply onset becomes coincident with the radial bore 28, causing the pump work chamber 112 to be relieved of pressure in favor of the suction chamber 24 via this diversion conduit. In this manner, the latest-possible end of supply is also controlled using the supply onset control opening 118. Once the radial bore 28 is uncovered by the supply onset control opening 118, no further injection can occur, so that the higher the control slide 107 is displaced in the direction of a late injection, the shorter is the supply stroke remaining for effective injection until the radial bore 28 is opened, and correspondingly the smaller is the injection quantity. In the upper extreme position of the control slide 107, the radial bore 28 is uncovered by the supply onset control opening 118 before the grooves 21 which serve to control supply onset enter into the control slide 107, with the result that initially no injection pressure at all can build up in the pump work chamber 112. Here again, this zero supply can either be used intentionally in order to shut off the engine, or it can be used as a safety means in the event of pump governor failure, for example in that the control slide 107 slips downwardly by virtue of its own weight.

The stepped embodiment of the control edge 119 effects a variable maximum fuel supply quantity, for instance for full load and for engine starting, depending upon the rotational position of the pump piston 103. During starting, by means of the corresponding rotational position of the pump piston 103, the radial bore 28, acting as the opening controlling the end of fuel supply, is uncovered somewhat later that at full load, during which a smaller injection quantity is needed than during starting.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines comprising at least one pumping unit having a pump cylinder (2) and a pump piston (3) defining together a pump work chamber (12), a relief conduit (15) within said piston communicating with said work chamber, a control slide axially displaceable on the pump piston to control at least one fuel quantity control conduit (20,21) provided in the pump piston in communication with said relief conduit, a relief bore (23) in said control slide, said relief conduit being arranged to discharge into a fuel supply onset control opening (18,118) disposed in a surface of the pump piston, said fuel supply onset control opening being arranged to communicate at least during a bottom dead center position assumed by the pump piston with a suction chamber of lower pressure, said suction chamber being fillable with fuel disposed peripherally of a portion of the pump cylinder, and surrounding the control slide so as to surround a portion of the pump piston, and the fuel supply onset control opening discharges into the suction chamber upon emerging from within the pump cylinder at least during said bottom dead center position, said fuel supply onset control opening being arranged to be closed by the pump cylinder after the pump piston has traversed a predetermined stroke regardless of displacement in position of said control slide, and fuel pressure is supplied to said pump work chamber until one of said quantity control conduits (20,21) is coincident with said relief bore (23) in said control slide.

2. A fuel injection pump as defined by claim 1, in which said at least one fuel quantity control conduit communicates with said relief conduit extending longitudinally of said pump piston and said relief conduit communicates via a transverse bore with said fuel supply onset control opening in said piston which comprises a control groove.

3. A fuel injection pump as defined by claim 2, in which said control groove comprises a machined cut on a jacket surface of the pump piston, said machined cut having an upper and a lower control edge.

4. A fuel injection pump as defined by claim 2, in which said control groove comprises an annular groove in said jacket face.

5. A fuel injection valve as set forth in claim 1 in which said at least one quantity control conduit is oblique.

6. A fuel injection valve as set forth in claim 1 in which said at least one quantity control conduit is longitudinal.

7. A fuel injection pump for internal combustion engines comprising at least one pumping unit having a pump cylinder and a pump piston defining together a pump work chamber, a relief conduit within said piston communicating with said work chamber, a control slide axially displaceable on the pump piston to control at least one fuel quantity control conduit provided in the pump piston in communication with said relief conduit, said relief conduit being arranged to discharge into a fuel supply onset control opening disposed on a jacket surface of the pump piston, said fuel supply control opening being arranged to communicate at least during a bottom dead center position assumed by the pump piston with a suction chamber of lower pressure, said fuel supply control opening being arranged to be closed by the pump cylinder after said pump piston has traversed a predetermined stroke regardless of displacement in position of said control slide, said pump cylinder includes a diversion opening to a diversion conduit leading to said suction chamber of lower pressure and said diversion opening is arranged to coincide with the fuel supply onset control opening upon a predetermined stroke traversed by the pump piston.

8. A fuel injection pump as defined by claim 7. in which said at least one fuel quantity control conduit communicates with said relief conduit extending longitudinally of said pump piston and said relief conduit communicates via a transverse bore with said fuel supply onset control opening which comprises a control groove.

9. A fuel injection pump as defined by claim 8, in which said pump piston is rotatably mounted, an upper control edge of the control groove has a stepped course relative to a longitudinal axis of the pump piston and rotation of the pump piston varies a piston stroke extent providing communication between the control groove and the diversion opening.

10. A fuel injection pump as defined by claim 8, in which said pump piston is rotatably mounted, an upper control edge of the control groove has an oblique course relative to a longitudinal axis of the pump piston and rotation of the pump piston varies a piston stroke extent providing communication between the control groove and the diversion opening.

11. A fuel injection pump as defined by claim 8, in which said pump piston is rotatably mounted, an upper control edge of the control groove has a stepped and oblique course relative to a longitudinal axis of the pump piston and rotation of the pump piston varies a piston stroke extent providing communication between the control groove and the diversion opening.

12. A fuel injection pump as defined by claim 8, in which said pump piston has a maximum supply stroke shorter than another pump piston supply stroke required to close the fuel quantity control conduit by the control slide when the control slide has assumed a position of fuel supply shut off.

13. A fuel injection valve as set forth in claim 7 in which said at least one quantity control conduit is oblique.

14. A fuel injection valve as set forth in claim 7 in which said at least one quantity control conduit is longitudinal.

15. A fuel injection valve as set forth in claim 8 in which said at least one quantity control conduit is oblique.

16. A fuel injection valve as set forth in claim 8 in which said at least one quantity control conduit is longitudinal.

17. A fuel injection pump for internal combustion engines comprising at least one pumping unit having a pump cylinder (2) and a pump piston (3) defining together a pump work chamber (12), a relief conduit (15) within said pump piston communicating with said work chamber, a control slide axially displaceable on the pump piston to control at least one fuel quantity control conduit provided in the pump piston in communication with said relief conduit, said relief conduit being arranged to discharge into a fuel supply onset control opening (18,108) disposed on a jacket surface of said pump piston, said fuel supply onset control opening being arranged to communicate at least during a bottom dead center position assumed by the pump piston with a suction chamber of lower pressure, said suction chamber being fillable with fuel disposed peripherally of a portion of the pump cylinder, and surrounding the control slide so as to surround a portion of the pump piston, and the fuel supply onset control opening discharges into the suction chamber upon emerging from within the pump cylinder at least during said bottom dead center position, said fuel supply onset control opening being arranged to be closed by the pump cylinder after the pump piston has traversed a predetermined stroke regardless of displacement in position of said control slide, said pump cylinder includes a diversion opening to a diversion conduit leading to said suction chamber and said diversion opening is arranged to coincide with the fuel supply onset control opening upon a predetermined stroke traversed by the pump piston.

18. A fuel injection valve as set forth in claim 17 in which said at least one quantity control conduit is oblique.

19. A fuel injection valve as set forth in claim 17 in which said at least one quantity control conduit is longitudinal.

* * * * *